US010294636B2

(12) United States Patent
Leslie et al.

(10) Patent No.: US 10,294,636 B2
(45) Date of Patent: May 21, 2019

(54) SYSTEM AND METHOD OF ESTIMATING FATIGUE IN A LIFTING MEMBER

(71) Applicant: CQMS Pty Ltd, Murarrie, Queensland (AU)

(72) Inventors: Bruce Alexander Leslie, Goodna (AU); David Clinton Andrews, Goodna (AU)

(73) Assignee: CQMS PTY LTD, Murarrie, Queensland (AU)

( * ) Notice: Subject to any disclaimer, the term of this patent is extended or adjusted under 35 U.S.C. 154(b) by 0 days.

(21) Appl. No.: 15/539,633

(22) PCT Filed: Dec. 24, 2014

(86) PCT No.: PCT/AU2014/050450

§ 371 (c)(1),
(2) Date: Jun. 23, 2017

(87) PCT Pub. No.: WO2016/101003

PCT Pub. Date: Jun. 30, 2016

(65) Prior Publication Data

US 2018/0258617 A1 Sep. 13, 2018

(51) Int. Cl.

| | |
|---|---|
| ***E02F 9/24*** | (2006.01) |
| ***E02F 9/26*** | (2006.01) |
| ***E02F 9/22*** | (2006.01) |
| *G07C 5/02* | (2006.01) |

(52) U.S. Cl.
CPC ..... *E02F 9/267* (2013.01); *E02F 9/226* (2013.01); *E02F 9/24* (2013.01)

(58) Field of Classification Search
CPC .... E02F 9/267; E02F 9/24; E02F 9/26; G07C 5/02; G07C 5/00; G01M 5/00
USPC ..... 701/31.9
See application file for complete search history.

(56) References Cited

U.S. PATENT DOCUMENTS

| | | | | |
|---|---|---|---|---|
| 6,314,818 B1 * | 11/2001 | Mandon | E02F 3/34 | 73/781 |
| 2010/0100338 A1 * | 4/2010 | Vik | G01M 5/0033 | 702/42 |
| 2010/0162825 A1 * | 7/2010 | Karp | G01M 5/0033 | 73/799 |

(Continued)

FOREIGN PATENT DOCUMENTS

| | | |
|---|---|---|
| WO | 2013/040633 A1 | 3/2013 |
| WO | 2016/101003 A1 | 6/2016 |

OTHER PUBLICATIONS

International Search Report and Written Opinion for PCT/AU2014/050450 dated Apr. 15, 2015; 8 pages.

(Continued)

*Primary Examiner* — Tan Q Nguyen
(74) *Attorney, Agent, or Firm* — Schwabe Williamson & Wyatt, PC

(57) ABSTRACT

A system of estimating fatigue in a lifting member, the system including: a first sensor configured to measure a first load related to a ram, the ram being connected to the lifting member; and a calculating device configured to: determine an actuator load based on the first load; determine a first force based on the actuator load; estimate a unit of fatigue life based on the first force; and estimate a fraction of total fatigue life consumed for a portion of the lifting member based on the unit of fatigue life and a fatigue life adjustment value.

21 Claims, 3 Drawing Sheets

(56) References Cited

U.S. PATENT DOCUMENTS

| | | | | |
|---|---|---|---|---|
| 2014/0020917 | A1* | 1/2014 | Weyer | E02F 3/3663 173/47 |
| 2014/0244101 | A1* | 8/2014 | Chitty | E02F 9/2054 701/31.6 |

OTHER PUBLICATIONS

Stress and Strain [Retrieved from the Internet on Apr. 13, 2015] <URL: http://web.archive.org/web/201410182 I I 733/https://www.nde-ed.org/EducationResources/CommunityCollege/ Materials/Mechanical/StressStrain.htm> Published on Oct. 18, 2014 as per Way Back Machine Whole Document.

Fatigue [Retrieved from the Internet on Apr. 13, 2015] <URL: http://web.archive.org/web/2014101821240 I/https://www.nde-ed.org/EducationResources/CommunityCollege/Materials/Mechanical/Fatigue.htm> Published on Oct. 18, 2014 as per Way Back Machine Whole Document.

Patent Cooperation Treaty; International Preliminary Report on Patentability for PCT/AU2014/050450 dated Jun. 27, 2017; 5 pages.

* cited by examiner

SYSTEM AND METHOD OF ESTIMATING FATIGUE IN A LIFTING MEMBER

CROSS-REFERENCE TO RELATED APPLICATION

The present application is a national phase entry under 35 U.S.C. § 371 of International Application No. PCT/US2014/050450, filed Dec. 24, 2014, entitled "A SYSTEM AND METHOD OF ESTIMATING FATIGUE IN A LIFTING MEMBER," which designates the United States of America, the entire disclosure of which is hereby incorporated by reference in its entirety and for all purposes.

FIELD OF THE INVENTION

The invention relates to a system and method of estimating fatigue in a lifting member. In particular, the invention relates, but is not limited, to a system and method of estimating fatigue in an excavator arm.

BACKGROUND TO THE INVENTION

Reference to background art herein is not to be construed as an admission that such art constitutes common general knowledge in Australia or elsewhere.

Currently, strain gauges are used to measure strain at points in an excavator arm. The measurements from strain gauges in turn allow the stress and expected fatigue life at points in the excavator arm to be calculated.

Strain gauges are usually attached to the excavator arm by an adhesive. However, as excavator environments are quite harsh, strain gauges and their associated cables often fail or are dislodged from the excavator. This may present a safety issue as the stress experienced by the excavator arm is not measured and/or recorded. This also results in the fatigue life of the points in the excavator arm being overestimated.

In addition, as strain gauges may, for example, be retrofitted to the excavator arm, the specific mounting orientation required for strain gauges to accurately function, contributes to the inconvenience of using strain gauges to measure strain within the excavator arm.

OBJECT OF THE INVENTION

It is an aim of this invention to provide a system and method of estimating fatigue in a lifting member which overcomes or ameliorates one or more of the disadvantages or problems described above, or which at least provides a useful alternative.

Other preferred objects of the present invention will become apparent from the following description.

SUMMARY OF INVENTION

In one form, although not necessarily the only or broadest form, the invention resides in a system of estimating fatigue in a lifting member, the system including:

a first sensor configured to measure a first load related to a ram, the ram being connected to the lifting member; and a calculating device configured to:

determine an actuator load based on the first load;

determine a first force based on the actuator load;

estimate a unit of fatigue life based on the first force; and estimate a fraction of total fatigue life consumed for a portion of the lifting member based on the unit of fatigue life and a fatigue life adjustment value.

Preferably, the lifting member includes an excavator arm and a bucket. Preferably, the excavator arm includes a boom and a stick. Preferably, the ram is connected between the boom and a cab platform. In an alternative form, the ram is connected between the boom and the stick. In a further alternative form, the ram member is connected between the stick and the bucket.

Preferably, the actuator load related to the ram is in the form of a pressure.

Preferably, the system includes a first related sensor. Preferably, the first related sensor is configured to measure a first related load associated with the ram. Preferably, the first related load is in the form of pressure.

Preferably, the actuator load is in the form of a pressure difference between the first load measured by the first sensor and the first related load measured by the first related sensor. Alternatively, the actuator load is in the form of the first load.

Preferably, the pressures related to the ram are transferred to a shaft of the ram to provide actuation thereof. Preferably, the ram is a hydraulic ram.

Preferably, the calculating device estimates the first force based on the actuator load by applying a first constant to the actuator load. Preferably, the first constant is in the form an area over which the actuator load is transferred. Preferably, the area over which the actuator load is transferred is an area of a piston in the ram to provide actuation thereof.

Preferably, the calculating device estimates the unit of fatigue life based on the first force with a fatigue relationship. Preferably, the calculating device estimates the unit of fatigue life based on the first force by determining a cyclic effect of the first force and dividing the cyclic effect by a critical damage factor. Preferably, the critical damage factor is in the form of cycles until estimated fatigue failure due to the first force.

Preferably, the calculating device estimates the fraction of fatigue life consumed for the portion of the lifting member by applying the fatigue life adjustment to the unit of fatigue life. Preferably, the fatigue life adjustment value is an estimated value that adjusts the unit of fatigue life based on the first force to a unit of fatigue life estimated in the portion of the lifting member.

Preferably, the fatigue life adjustment value adjusts the fatigue relationship used to calculate the unit of fatigue life in order to estimate the unit of fatigue life in the portion of the lifting member. Preferably, the fatigue life adjustment value accounts for a geometrical relationship, material characteristics, residual stresses, direction of loading and/or temperature.

Preferably, the fatigue life adjustment value includes a relation to a corresponding factor. Preferably, the corresponding factor is a ratio of estimated stress in the portion of lifting member to the force based on the actuator load. In a further form, the calculating device estimates the fraction of fatigue life consumed for the portion of the lifting member by applying the fatigue life adjustment value directly to the force. Preferably, in this further form, the fatigue life adjustment value is in the form of the corresponding factor.

Preferably, the calculating device is configured to:

determine further actuator loads based on further first loads and/or further first related loads;

determine further forces based on the further actuator loads;

estimate units of fatigue life based on the further forces;

estimate the fraction of total fatigue life consumed for the portion of the lifting member based on the units of fatigue life and the fatigue life adjustment value.

Preferably, the calculating device is configured to define the first force and the further forces as a sequence of peak forces and valley forces. Normally, the peak forces and valley forces include forces of different force magnitude. Preferably, the peak forces are in the form of tensile forces. Preferably, the valley forces are in the form of compressive forces.

Preferably, the calculating device is configured to count a number of cycles and/or a number of half cycles for peak forces and valley forces of substantially equal force magnitude.

Preferably, the calculating device is configured to:

multiply the number of cycles and/or the number of half cycles by their substantially equal force magnitude to form force-cycle values;

divide the force-cycle values by their respective critical damage values to form the units of fatigue life; and sum the units of fatigue life and apply the fatigue life adjustment value to estimate the fraction of total fatigue life consumed for the portion of the lifting member.

Preferably, the respective critical damage values are in the form of cycles until estimated fatigue failure due to each of the respective substantially equal force magnitudes.

Preferably, in summing the units of fatigue life and applying the fatigue life adjustment value to estimate the fraction of fatigue life consumed for the portion of the lifting member, the calculating device is configured to exclude units of fatigue life that are below an endurance limit. Preferably, the endurance limit is in the form of a value where the portion of the lifting member is substantially unaffected by the first force and/or the further forces in terms of fatigue.

Preferably, the calculating device is configured to trigger an alarm when the fraction of total fatigue life consumed for the portion of the lifting member reaches a critical cumulative damage value.

In another form the invention resides in a method of estimating fatigue in a lifting member, the method including the steps of:

determining an actuator load related to a ram, the ram being associated with the lifting member;

determining a first force based on the actuator load;

estimating a unit of fatigue life based on the first force; and estimating a fraction of total fatigue life consumed for a portion of the lifting member based on the unit of fatigue life and a fatigue life adjustment value.

Preferably, the step of determining the actuator load related to the ram includes measuring a first pressure. Preferably, the step of determining the actuator load related to the ram includes measuring a first related pressure. Preferably, the step of determining the actuator load related to the ram includes defining a pressure difference between the first pressure and the first related pressure.

Preferably, the step of estimating the first force based on the actuator load includes applying a first constant. Preferably, the first constant is in the form an area over which the actuator load is transferred. Preferably, the area over which the actuator load is transferred is an area of a piston in the ram to provide actuation thereof.

Preferably, the step of estimating the unit of fatigue life based on the first force includes applying a fatigue relationship. Preferably, the step of estimating the unit of fatigue life based on the first force includes determining a cyclic effect of the first force and dividing the cyclic effect by a critical damage factor. Preferably, the critical damage factor is in the form of cycles until estimated fatigue due to the first force.

Preferably, the step of estimating the fraction of total fatigue life consumed for the portion of the lifting member based on the unit of fatigue life and the fatigue life adjustment value includes applying the fatigue life adjustment to the unit of fatigue life. Preferably, the fatigue life adjustment value is an estimated value that adjusts the unit of fatigue life based on the first force to a unit of fatigue life estimated in the portion of the lifting member.

Preferably, the fatigue life adjustment value accounts for a geometrical relationship, material characteristics, residual stresses, direction of loading and/or temperature. Preferably, the fatigue life adjustment value adjusts the fatigue relationship used to calculate the unit of fatigue life in order to estimate the unit of fatigue life in the portion of the lifting member.

Preferably, the fatigue life adjustment value includes a relation to a corresponding factor. Preferably, the corresponding factor is a ratio of estimated stress in the portion of lifting member to the force based on the actuator load. In a further form, the step of estimating the fraction of total fatigue life consumed for the portion of the lifting member based on the unit of fatigue life and the fatigue life adjustment value includes applying the fatigue life adjustment value directly to the force. Preferably, in this further form, the fatigue life adjustment value is in the form of the corresponding factor.

Preferably, the method further includes the step of:

determining further actuator loads based on further first loads and/or further first related loads;

determining further forces based on the further actuator loads;

estimating units of fatigue life based on the further forces;

estimating the fraction of total fatigue life consumed for the portion of the lifting member based on the units of fatigue life and the fatigue life adjustment value.

Preferably, the step of estimating units of fatigue life based on the further forces includes defining the first force and the further forces as a sequence of peak forces and valley forces. Normally, the peak forces and valley forces include forces of different force magnitude. Preferably, the peak forces are in the form of tensile forces. Preferably, the valley forces are in the form of compressive forces.

Preferably, the step of estimating units of fatigue life based on the further forces includes counting a number of cycles and/or a number of half cycles for peak forces and valley forces of substantially equal force magnitude.

Preferably, the step of estimating units of fatigue life based on the further forces includes:

multiplying the number of cycles and/or the number of half cycles by their substantially equal force magnitude to form force-cycle values; and dividing the force-cycle values by their respective critical damage values to form the units of fatigue life.

Preferably, the respective critical damage values are in the form of cycles until estimated fatigue failure due to each of the respective substantially equal force magnitudes.

Preferably, the step of estimating the fraction of total fatigue life consumed for the portion of the lifting member based on the units of fatigue life and the fatigue life adjustment value includes summing the units of fatigue life and applying the fatigue life adjustment value.

Preferably, the method further includes the steps of triggering an alarm when the fraction of total fatigue life consumed for the portion of the lifting member reaches a critical cumulative damage value.

Further features and advantages of the present invention will become apparent from the following detailed description.

BRIEF DESCRIPTION OF THE DRAWINGS

By way of example only, preferred embodiments of the invention will be described more fully hereinafter with reference to the accompanying figures, wherein.

DETAILED DESCRIPTION OF THE DRAWINGS

Figure 1:
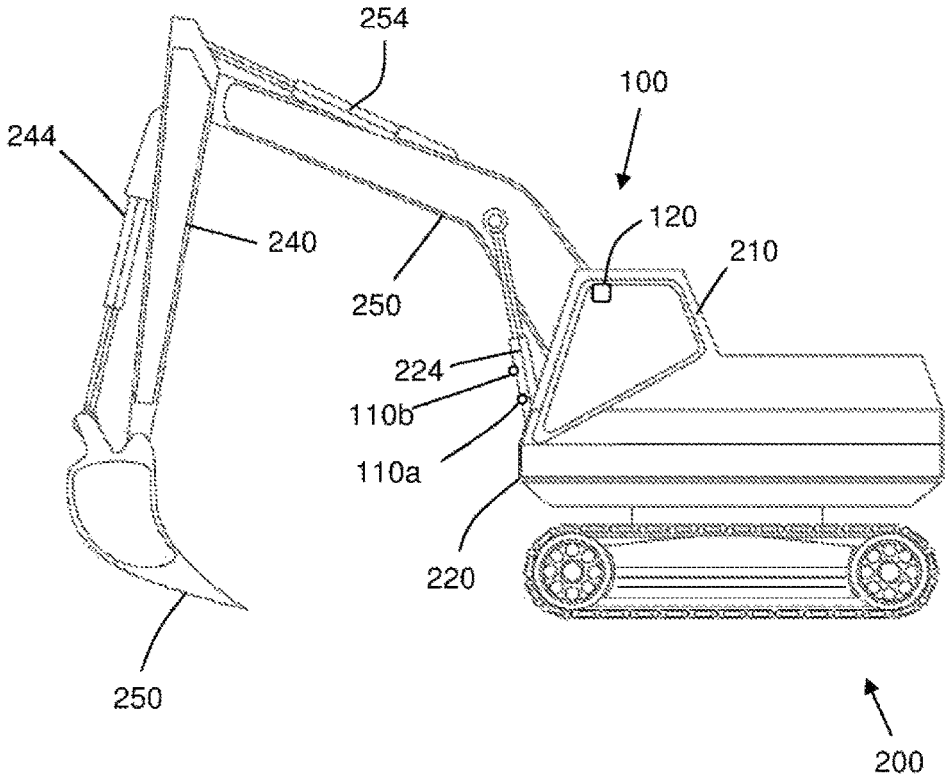
FIG. 1 illustrates a system of estimating fatigue in a lifting member according to an embodiment of the invention.

FIG. 1 illustrates a system 100 of estimating fatigue in a lifting member, according to an embodiment of the invention, fitted to lifting equipment in the form of an excavator 200. It would be appreciated that the system 100 may be fitted to other lifting equipment including a backhoe or crane.

The excavator 200 includes a cab 210, a cab platform 220 and a lifting member in the form of an excavator arm and a bucket 230. The excavator arm includes members includes a stick 240 and a boom 250. The boom 250 is pivotally connected to the cab platform 220. The boom 250 is also pivotally connected to the stick 240, which is pivotally connected to the bucket 230.

The excavator 200 includes a ram 244 associated with the stick 240. The excavator 200 also includes a ram 254 associated with the boom 250. In addition, a ram 224 is located between the cab platform 220 and boom 250. It would be appreciated that ram 224 is also associated the boom 250 and, similarly, that ram 254 is associated with the stick 240.

The system 100 includes a first sensor and a first related sensor in the form of pressure sensors 110*a*, 110*b*. The system also includes a calculating device 120 and an alarm. The pressure sensors 110*a*, 110*b* and the alarm are in communication with the calculating device 120. It would be appreciated that the pressure sensors 110*a*, 110*b* and the alarm may be in wired or wireless communication with the calculating device 120.

In this embodiment, the pressure sensors 110*a*, 110*b* are connected to the ram 224 via hydraulic hoses (not shown) to measure a first load and a first related load, in the form of pressure, either side of a piston in the ram 224. It would also be appreciated by a person skilled in the art that the pressure sensors 110*a*, 110*b* may be connected to rams 254, 244, respectively, to measure the related pressures of these rams in order to carry out the present invention.

The calculating device 120 is installed in the cab 210. The calculating device 120 is configured to receive the first load and the first related load (i.e. pressure) from the pressure sensors 110*a*, 110*b* and determine an actuator load. That is, the actuator load, in this embodiment, is in the form of a pressure difference between the first load measured by the first sensor 110*a* and the first related load measured by the first related sensor 110*b*. It would be appreciated by a person skilled in the art that sensor 110*a* may be used alone to measure the actuator load if the pressure in the hydraulic hose connected to the first related sensor 110*b* remains substantially constant.

The calculating device 120 estimates a first force based on the actuator load. The calculating device 120 estimates the first force by applying a first constant to the actuator load. The first constant is in the form an area over which the actuation load is transferred in the ram 224. This area is taken as where the actuator load of the ram 224 is applied to a piston of the ram 224 to provide actuation thereof.

In view of the above, it would also be appreciated that the calculating device 120 is configured to determine further actuation loads based on further first loads and/or further first related loads measured by the first sensor 110*a* and the first related sensor 110*b*, respectively. From this, the calculating device 120 is configured to determine further forces, over a period of time, based on the further actuation loads. As would be appreciated by a person skilled in the art, the first force and further forces are typically of different magnitude. The calculating device 120 also records the first forces and the further force over a period of time for calculation of a fatigue life, as outlined below.

The calculating device 120 is configured to estimate a fraction of total fatigue life of the lifting member (i.e. the excavator arm). That is, the calculating device 120 is configured to estimate unit(s) of fatigue life based on the first force and/or further forces. Following this, the calculating device 120 is configured to estimate a fraction of total fatigue life consumed for the portion of the lifting portion based on the unit(s) of fatigue life and a fatigue life adjustment value.

In order to estimate unit(s) of fatigue life, the calculating device 120 is configured to define the first force and/or the further forces as a sequence of peak forces and valley forces. These peak forces and valley forces represent tensile and compressive forces, respectively, and are typically of different magnitudes given that loads vary in the ram 224 due to different working conditions. It would be appreciated that in further embodiments that stain hysteresis energy, for example may be used rather than defining the above peak force and valley force. This will depend on the fatigue relationship used to derive the unit of fatigue life discussed below.

Following the above, the calculating device 120 is configured to count a number of cycles and/or a number of half cycles for peak forces and valley forces of substantially equal force magnitude. The calculating device then multiplies the number of cycles and/or the number of half cycles by their substantially equal force magnitude to form force-cycle values. These force-cycle values are then divided by their respective critical damage values to form the units of fatigue life. The critical damage values represent cycles until estimated fatigue failure due to each respective equal force magnitude. For example, a force having a magnitude of 10 kN may result in fatigue after 100 repeated cycles.

To estimate the fraction of total fatigue life consumed for the portion of the excavator arm, the calculating device 120 sums the units of fatigue life and applies the fatigue life adjustment value. The fatigue life adjustment value is an estimated value that adjusts the unit of fatigue life based on the first force and/or further forces to a unit of fatigue life estimated in the portion of the lifting member. In this regard, it would be appreciated that the fatigue life adjustment value adjusts any fatigue relationship used to derive the unit of fatigue life with the first force (e.g., Miner's Rule, Paris'

Law, Coffin Manson relation etc.) such that the unit of fatigue life in the portion of the lifting member may be estimated.

The method of estimating fatigue in the excavator arm (i.e. lifting member) is outlined in further detail below having regard to FIG. 2.

The calculating device 120 is also configured to trigger the alarm when the fraction of total fatigue life consumed for the portion of the lifting member reaches a critical cumulative damage value. The alarm is both visual and audible in this embodiment.

Figure 2:
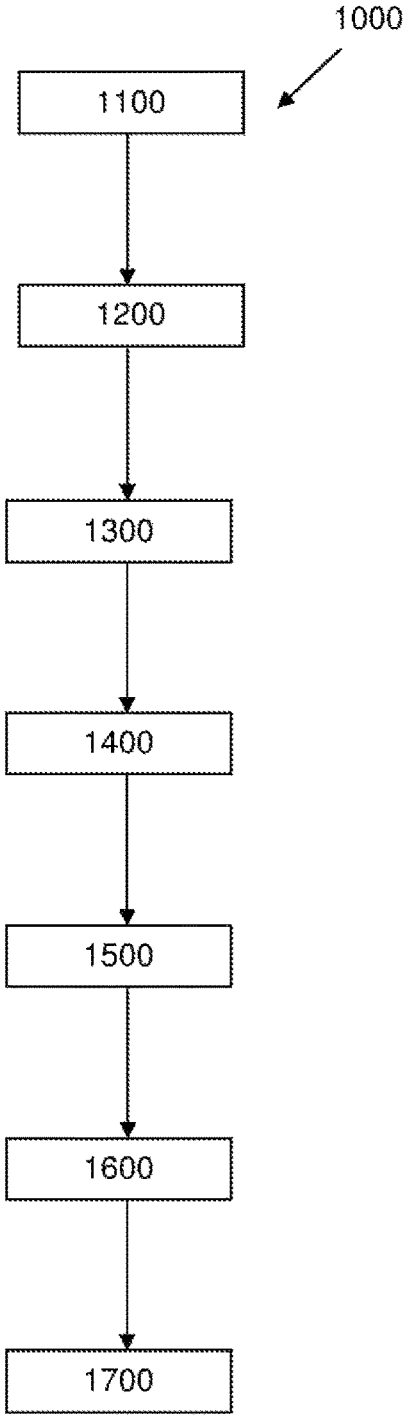
FIG. 2 illustrates a flow chart of a method of estimating, fatigue in a lifting member with reference to FIG. 1.

FIG. 2 illustrates a method 1000 of estimating fatigue in the excavator arm with reference to FIG. 1.

At step 1100, the pressure sensors 110*a*, 110*b* measure loads in the form of a first pressure and a first related pressure, respectively, associated with ram 224. The pressure sensors 110*a*, 110*b* measure pressures either side of a piston in the ram 224. The measured pressures are communicated to and received by the calculating device 120.

At step 1200, the calculating device 120 determines an actuator load based on the first pressure and the first related pressure. That is, the calculating device 120 determines a pressure difference between the first pressure and the first related pressured by subtracting the first related pressure from the first pressure. The pressure difference forms the actuator load.

At step 1300, the calculating device 120 estimates a first force based on the actuator load. The step of estimating the first force based on the actuator load includes applying a first constant to the actuator load. The first constant is in the form of an area over which the actuator load is transferred in the ram 224. That is, in this embodiment, the area over which the load of the ram 224 is transferred is taken as an area of a piston in the ram 224 where the actuator load (i.e. pressure) is transferred to provide actuation thereof.

At step 1400, the first force in the portion of the excavator arm is recorded by the calculating device 120.

In view of the above, it would be appreciated that steps 1100 to 1400 may be repeated in order to determine further actuator loads related to the ram; and estimate further forces based on the further actuator loads. Theses further forces are also recorded by the calculating device 120. The first force and further forces are typically of different magnitudes given that loads vary in the ram 224 due to different working conditions.

To this end, whilst the first force may be used in the remaining steps for estimating fatigue in the lifting member, as the lifting member is unlikely to fail after one fatigue cycle, typically the first force along with the further forces will be used in estimating fatigue in the lifting member. Accordingly, the remaining steps for estimating fatigue life below are based on the first force and the further forces.

Figure 3:
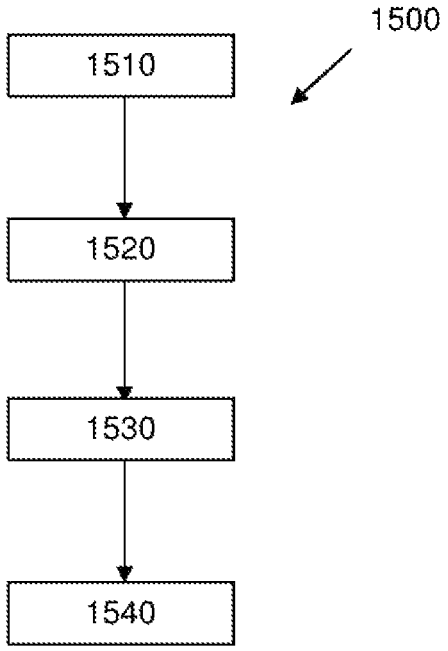
FIG. 3 illustrates a flow chart for part of the method of estimating fatigue in the lifting member as outlined in FIG. 2.

At step 1500, the calculating device 120 estimates units of fatigue life based on the first force and further forces. Estimating units of fatigue life based on the first force and further forces is outlined further in FIG. 3.

At step 1510, the calculating device 120 defines the first force and the further forces as a sequence of peak forces and valley forces. As mentioned above, the peak forces and valley forces represent tensile and compressive forces, respectively. Furthermore, as they correlate to the first force and the further forces, are typically of different magnitudes given that loads vary in the ram 224 due to different working conditions.

At step 1520, the calculating device 120 then counts a number of cycles and/or a number of half cycles for peak forces and valley forces of substantially equal magnitude. That is, the calculating device determines the amount of times forces of equal magnitude have been repeated in a cycle and/or half cycle. As would be appreciated by a person skilled in the art, the lifting member is exposed to cyclic loading in use.

At step 1530, the calculating device 120 multiplies the number of cycles and/or the number of half cycles by their substantially equal force magnitude to form force-cycle values.

At step 1540, the calculating device then divides the force-cycle values by a critical damage value to form the units of fatigue life. The critical damage value represents when fatigue is estimated to occur due to the repeated forces of equal magnitude.

At step 1600, the calculating device 120 sums the units of fatigue life and applies the fatigue life adjustment value to estimate a fraction of total fatigue life consumed for a portion of the excavator arm (i.e. lifting member). The calculating device 120 is configured to exclude units of fatigue life that are below an endurance limit. Units of fatigue life below the endurance limit do not substantially contribute to the fraction of total fatigue life and, therefore, may be excluded in order to improve accuracy. As would be appreciated, the total fatigue life is an estimate of when the lifting member will fail due to fatigue.

The fatigue life adjustment value is an estimated value that adjusts the unit of fatigue life based on the first force to a unit of fatigue life estimated in the portion of the lifting member. The fatigue life adjustment value therefore accounts for a geometrical relationship, material characteristics, residual stresses, direction of loading and/or temperature. In this regard, it would be appreciated that the fatigue life adjustment value adjusts any fatigue relationship used to derive the unit of fatigue life with the first force (e.g., Miner's Rule, Paris' Law, Coffin Manson relation etc.) such that the unit of fatigue life in the portion of the lifting member may be estimated.

To this end, in a further form, it would be appreciated by a person skilled in the art that the fatigue life adjustment value may, for example, be applied to the first force and/or further forces in calculating the units of fatigue life. In this further form, the fatigue life adjustment value includes a relation to a corresponding factor that is in the form of a ratio of estimated stress in the portion of lifting member to the force(s) based on the actuator load.

At step 1700, in response to estimating the fraction of total fatigue life consumed for the portion of the lifting member at or above a predetermined value, the calculating device communicates to a user with the alarm. This alarm indicates that the lifting member is expected to fail soon due to fatigue.

The system 100 and method 1000 provide a number advantages over the prior art. The connection of the pressure sensors 110*a*, 110*b* to the ram 224 are less likely to fail compared to a strain gauge being adhesively bonded to the excavator arm. Accordingly, as the connection of the pressure sensors 110 is more suited to an excavator environment, the system 100 and method 1000 provides a more reliable process of estimating the load in the excavator arm compared to strain gauges.

In addition, as the pressure sensors 110 are easily connected to the ram 224 or fluid lines of the ram 224, the system 100 can easily be retrofitted to the excavator 200 and, unlike strain gauges, do not require a specific orientation to function accurately.

The system 100 and method 1000 also allow for a substantially accurate estimate of fatigue life for the lifting member including, the excavator arm and bucket 230. The system 100 and method 1000 apply a substantially direct method of estimating fatigue life with the use of the fatigue life adjustment value, which improves processing time by, for example, avoiding calculations of stress or strain within the lifting member.

Furthermore, with communication from the calculating device 120, the alarm can communicate to a user when preventative maintenance is required. In this regard, productivity is increased as unexpected failures the excavator arm, for example, are substantially avoided.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

In this specification, the terms 'comprises', 'comprising', 'includes', 'including', or similar terms are intended to mean a non-exclusive inclusion, such that a method, system or apparatus that comprises a list of elements does not include those elements solely, but may well include other elements not listed.

The invention claimed is:

1. A system of estimating fatigue in a lifting member, the system including:

a first sensor configured to measure a first load related to a ram, the ram being connected to the lifting member; and a calculating device configured to:

determine an actuator load based on the first load;

determine a first force based on the actuator load;

estimate a unit of fatigue life based on the first force; and estimate a fraction of total fatigue life consumed for a portion of the lifting member based on the unit of fatigue life and a fatigue life adjustment value.

2. The system of claim 1, wherein the calculating device estimates the first force based on the actuator load by applying a first constant to the actuator load.

3. The system of claim 1, wherein the calculating device estimates the unit of fatigue life based on the first force with a fatigue relationship.

4. The system of claim 3, wherein the fatigue relationship includes determining the cyclic effect of the first force and dividing the cyclic effect by a critical damage factor.

5. The system of claim 1, wherein the calculating device estimates the fraction of fatigue life consumed for the portion of the lifting member by applying the fatigue life adjustment to the unit of fatigue life.

6. The system of claim 5, wherein the fatigue life adjustment value is an estimated value that adjusts the unit of fatigue life based on the first force to a unit of fatigue life estimated in the portion of the lifting member.

7. The system of claim 1, wherein the calculating device is configured to:

determine further actuator loads based on further first loads and/or further first related loads;

determine further forces based on the further actuator loads;

estimate units of fatigue life based on the further forces; and estimate the fraction of total fatigue life consumed for the portion of the lifting member based on the units of fatigue life and the fatigue life adjustment value.

8. The system of claim 7, wherein the calculating device is configured to define the first force and the further forces as a sequence of peak forces and valley forces.

9. The system of claim 8, wherein the calculating device is configured to count a number of cycles and/or a number of half cycles for peak forces and valley forces of substantially equal force magnitude.

10. The system of claim 9, wherein the calculating device is configured to:

multiply the number of cycles and/or the number of half cycles by their substantially equal force magnitude to form force-cycle values;

divide the force-cycle values by their respective critical damage values to form the units of fatigue life; and sum the units of fatigue life and apply the fatigue life adjustment value to estimate the fraction of total fatigue life consumed for the portion of the lifting member.

11. The system of claim 10, wherein in summing the units of fatigue life and applying the fatigue life adjustment value to estimate the fraction of fatigue life consumed for the portion of the lifting member, the calculating device is configured to exclude units of fatigue life that are below an endurance limit.

12. The system of claim 11, wherein the endurance limit is in the form of a value where the portion of the lifting member is substantially unaffected by the first force and/or the further forces in terms of fatigue.

13. The system of claim 1, wherein the lifting member includes an excavator arm and a bucket.

14. The system of claim 1, wherein the actuator load related to the ram is in the form of a pressure.

15. The system of claim 1, wherein a first related sensor is configured to measure a first related load associated with the ram.

16. The system of claim 15, wherein the actuator load is in the form of a pressure difference between the first load and the first related load measured by the first related sensor.

17. A method of estimating fatigue in a lifting member, the method including the steps of:

determining an actuator load related to a ram, the ram being associated with the lifting member;

determining a first force based on the actuator load;

estimating a unit of fatigue life based on the first force; and estimating a fraction of total fatigue life consumed for a portion of the lifting member based on the unit of fatigue life and a fatigue life adjustment value.

18. The method of claim 17, wherein the step of estimating the fraction of total fatigue life consumed for the portion of the lifting member based on the unit of fatigue life and the fatigue life adjustment value includes applying the fatigue life adjustment to the unit of fatigue life.

19. The method of claim 17, wherein the fatigue life adjustment value is an estimated value that adjusts the unit of fatigue life based on the first force to a unit of fatigue life estimated in the portion of the lifting member.

20. The method of claim 17, wherein the method further includes the steps of triggering an alarm when the fraction of total fatigue life consumed for the at least one portion reaches a critical cumulative damage value.

21. The method of claim 17, wherein the lifting member includes an excavator arm and a bucket.

* * * * *